United States Patent [19]

Katayama

[11] Patent Number: 4,696,277

[45] Date of Patent: Sep. 29, 1987

[54] ENGINE ALARM SYSTEM

[75] Inventor: Takeshi Katayama, Kariya, Japan

[73] Assignee: Nippondenso Co., Ltd., Kariya, Japan

[21] Appl. No.: 926,175

[22] Filed: Nov. 3, 1986

[30] Foreign Application Priority Data

Nov. 4, 1985 [JP] Japan ..... 60-247604

[51] Int. Cl.[4] ..... F02B 3/00

[52] U.S. Cl. ..... 123/479; 73/119 A

[58] Field of Search ..... 123/489, 479, 490; 73/119 A

[56] References Cited

U.S. PATENT DOCUMENTS

| | | | |
|---|---|---|---|
| 4,006,718 | 2/1977 | Konomi | 123/479 |
| 4,119,070 | 10/1978 | Asano | 73/119 A |
| 4,246,566 | 1/1981 | Endo | 73/119 A |
| 4,499,876 | 2/1985 | Yamamoto | 123/479 |
| 4,502,443 | 3/1985 | Hasegawa | 123/479 |
| 4,589,401 | 5/1986 | Karim | 123/479 |
| 4,615,321 | 10/1986 | Haefner | 123/479 |

FOREIGN PATENT DOCUMENTS

| | | | |
|---|---|---|---|
| 58-187533 | 1/1983 | Japan | 123/479 |

*Primary Examiner*—Ronald B. Cox

*Attorney, Agent, or Firm*—Cushman, Darby & Cushman

[57] ABSTRACT

An air-to-fuel ratio of an air-fuel mixture in an engine is controlled via a fuel supply system. The fuel supply system operates in accordance with a signal representing a desired air-to-fuel ratio of an air-fuel mixture in the engine. When the fuel supply system operates normally, an actual air-to-fuel ratio of the air-fuel mixture can be essentially equal to the desired air-to-fuel ratio. An actual air-to-fuel ratio of the air-fuel mixture is detected. A malfunction of the fuel supply system is detected in accordance with the detected actual air-to-fuel ratio and the desired air-to-fuel ratio. In the case where the fuel supply system includes fuel injection valves and an air-to-fuel ratio sensor is disposed in an exhaust passage of the engine, a malfunction of at least one of the fuel injection valves may be detected in accordance with whether or not an output signal from the air-to-fuel ratio sensor changes periodically in synchronism with operation cycles of the engine or revolution of the engine.

10 Claims, 14 Drawing Figures

ENGINE ALARM SYSTEM

BACKGROUND OF THE INVENTION

1. Field of the Invention

This invention relates generally to an engine alarm system, and specifically to an alarm apparatus for an engine control system.

2. Description of the Prior Art

Japanese published unexamined utility model application No. 60-134870 discloses an apparatus for detecting a breaking down of the control winding of at least one of electromagnetic fuel injection valves in an engine fuel supply control system. In this apparatus, the behavior of an electrical signal at the fuel injection valves is monitored via a sensor. The detection of the breaking down of the valve winding is performed in accordance with the monitored behavior of the electrical signal.

Japanese published unexamined utility model application No. 58-142373 discloses a diagnosis system for electronically-controlled fuel injection devices. This system includes an arrangement which monitors the behavior of an electrical signal at electromagnetic fuel injection valves. The monitored behavior of the electrical signal is used for the diagnosis of the fuel injection valves.

In general, the apparatus and the system in the above-mentioned Japanese utility model applications can not detect a malfunction of the electromagnetic fuel injection valve caused by abnormal operation of mechanical parts of the valve or caused by clogging of a fuel passage in the valve.

SUMMARY OF THE INVENTION

It is an object of this invention to provide a reliable engine alarm system.

It is another object of this invention to provide an engine alarm system which can detect a malfunction of an electromagnetic fuel injection valve resulting from causes including abnormal operation of mechanical parts of the valve and clogging of a fuel passage in the valve.

An engine alarm system according to a first aspect of this invention is applied to an electronic engine control system which performs at least fuel injection control of an engine via fuel injection valves in response to control signals which are derived from output signals of sensors detecting operating conditions of the engine and from an output signal of an air-to-fuel ratio sensor disposed in an exhaust system of the engine in accordance with a program stored in a microcomputer. In this alarm system, when the fuel injection control is being operative to supply the engine with a rich air-fuel mixture, detection is made as to whether or not the air-to-fuel ratio sensor periodically generates mixture lean signals in synchronism with revolutions of an output shaft of the engine. A malfunction of at least one of the fuel injection valves is determined in accordance with the detection of the periodical generations of the mixture lean signal.

In an engine alarm system according to a second aspect to this invention, an air-to-fuel ratio of an air-fuel mixture in an engine is controlled via a fuel supply system. The fuel supply system operates in accordance with a signal representing a desired air-to-fuel ratio of and air-fuel mixture in the engine. When the fuel supply system operates normally, an actual air-to-fuel ratio of the air-fuel mixture can be essentially equal to the desired air-to-fuel ratio. An actual air-to-fuel ratio of the air-fuel mixture is detected. A malfunction of the fuel supply system is detected in accordance with the detected actual air-to-fuel ratio and the desired air-to-fuel ratio. In the case where the fuel supply system includes fuel injection valves and an air-to-fuel ratio sensor is disposed in an exhaust passage of the engine, a malfunction of at least one of the fuel injection valves may be detected in accordance with whether or not an output signal from the air-to-fuel ratio sensor changes periodically in synchronism with operation cycles of the engine or revolution of the engine.

DESCRIPTION OF THE PREFERRED EMBODIMENTS

Figure 1:
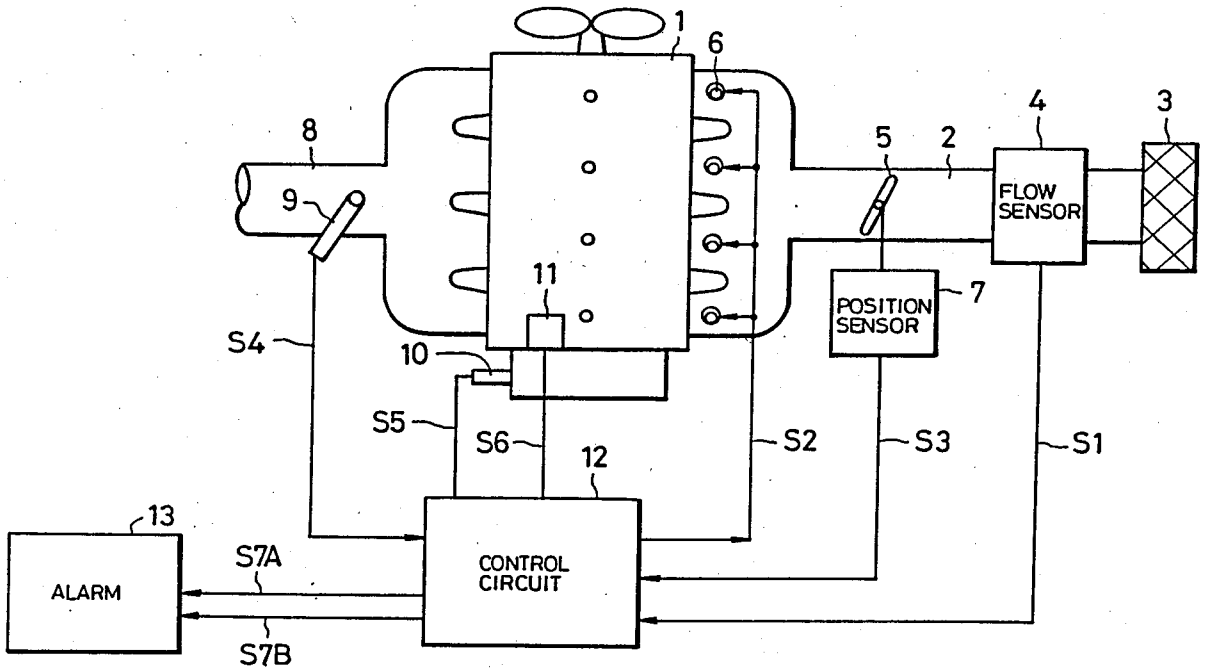
FIG. 1 is a diagram of an engine, an engine control system, and an engine alarm system according to a first embodiment of this invention.

With reference to FIG. 1, a four-cycle multi-cylinder internal combustion engine 1 is provided with an air intake duct 2 which extends between an air filter 3 and the engine block. Air is drawn into the engine cylinders via the filter 3 and the duct 2. Air flow meter or sensor 4 disposed in the duct 2 downstream of the filter 3 generates a signal S1 representing the rate of air flow into the engine cylinders. A rotatable throttle valve 5 disposed in the duct 2 downstream of the air flow meter 4 adjustably determines the rate of air flow into the engine cylinders. Specifically, the degree of opening through the throttle valve 5 depends on the angle or the position of the throttle valve 5, so that the rate of air flow into the engine cylinders also depends on the angle or the position of the throttle valve 5.

The segment of the air duct 2 downstream of the throttle valve 5 includes an intake manifold connected to the engine block. The intake manifold has branches leading to the respective engine cylinders via intake ports in the engine block. Electromagnetic or electrically-driven fuel injection valves 6 attached to the respective branches of the intake manifold serve to inject fuel into the manifold branches. The rate of fuel injection is controllable via a signal S2 applied to the fuel injection valves 6. Specifically, the fuel injection signal S2 includes a train of pulses which are generated synchronously with the engine crankshaft revolution. During the width or duration of a fuel injection pulse S2, the fuel injection valves 6 remain open and thus allow fuel injection. Accordingly, the quantity of fuel injected during each fuel injection stroke and also the rate of fuel injection are controlled by adjusting the duration of each fuel injection pulse S2.

A position sensor 7 associated with the throttle valve 5 generates a signal S3 representing the position of the throttle valve 5, that is, the degree of opening through the throttle valve 5.

An exhaust pipe arrangement 8 extends from the engine block. Exhaust gages are emitted from the engine cylinders to atmosphere via the exhaust pipe arrangement 8. An upstream segment of the exhaust pipe arrangement 8 includes an exhaust manifold connected to the engine block. The exhaust manifold has branches leading from the respective engine cylinderes via exhaust ports in the engine block and connected to a common exhaust pipe at a junction. An air-to-fuel ratio sensor 9, such as an oxygen gas sensor ($O_2$ sensor), has a sensing element disposed in the exhaust pipe 8 downstream of the junction of the exhaust manifold branches. The $O_2$ sensor 9 generates a signal S4 representing the air-to-fuel ratio of an air-fuel mixture which caused exhaust gas currently exposed to the sensing element of the sensor 9. Specifically, the signal S4 is in a high level state and in a low level state when the air-fuel mixture is richer than and leaner than the stoichiometric mixture respectively.

An angular position sensor or crank angle sensor 10 associated with the camshaft or the crankshaft of the engine 1 generates a signal S5 representing a reference angular position or positions of the crankshaft, that is, a reference crank angle or crank angles. Specifically, the crank angle signal S5 includes reference pulses spaced at fixed crank angle intervals of 720°. The crank angle signal S5 also includes unit pulses spaced at small fixed crank angle intervals. Since the frequency of the unit crank angle pulses is proportional to the rotational speed of the crankshaft, the signal S5 also represents the engine speed.

A temperature sensor 11 attached to the engine block has a sensing element exposed to coolant of the engine 1. This sensor 11 generates a signal S6 representing the temperature of engine coolant.

A control circuit 12 including a microcomputer receives the air flow rate signal S1, the throttle position signal S3, the air-to-fuel ratio signal S4, the crank angle signal S5, and the coolant temperature signal S6, and generates the fuel injection signal S2 in accordance with the input signals S1, S3, S4, S5, and S6.

A visual or audible alarm 13 is electrically connected to the control circuit 12. As will be made clear hereinafter, when a malfunction of the fuel injection valve 6 is detected, the control circuit 12 outputs an alarm signal S7A to a first section of the alarm 13 to energize the latter. When a malfunction of the $O_2$ sensor 9 is detected, the control circuit 12 outputs an alarm signal S7B to a second section of the alarm 13 to energize the latter.

Figure 2:
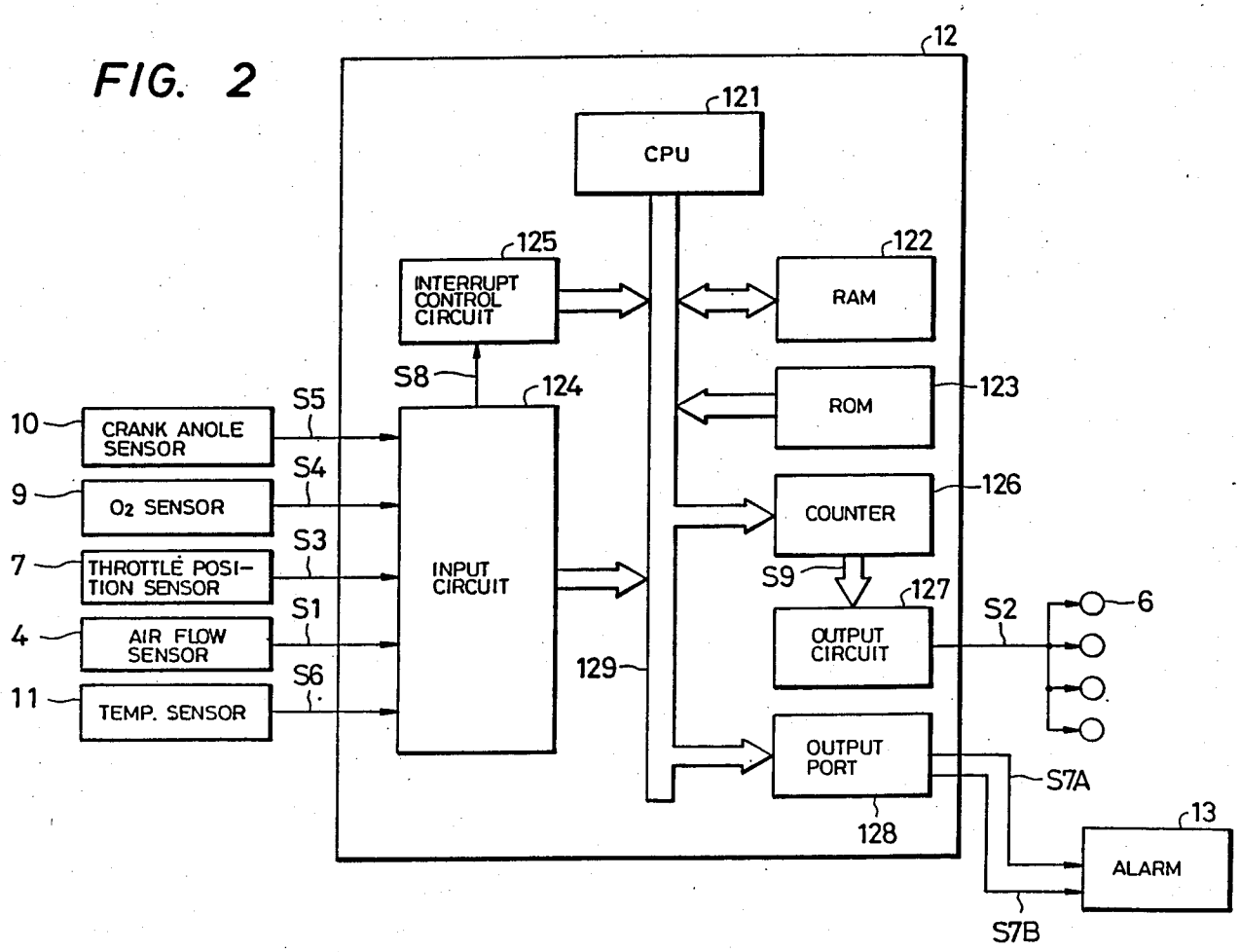
FIG. 2 is a block diagram of the engine control system and the engine alarm system of FIG. 1.

As shown in FIG. 2, the control circuit 12 includes a central processing unit (CPU) 121, the random-access memory (RAM) 122, a read-only memory (ROM) 123, an input circuit 124, an interrupt control circuit 125, a counter 126, an output circuit 127, and an output port 128. These units 121–128 are connected via bus lines 129. The input circuit 124 is connected to the sensors 4, 7, 9. 10, and 11 to receive the air flow rate signal S1, the throttle position signal S3, the air-to-fuel ratio signal S4, the crank angle signal S5, and the coolant temperature signal S6. The input circuit 124 includes an analog-to-digital converter or converters which change the input analog signals, such as the air flow rate signal S1, the throttle position signal S3, and the coolant temperature signal S6, to corresponding digital signals. The input circuit 124 outputs a trigger or command signal S8 to the interrupt control circuit 125, via a connection between the circuits 124 and 125, in accordance with the crank angle signal S5. The interrupt control circuit 125 supplies the CPU 121 with interrupt signals which determine timings of interrupt processes on the basis of the crank angle signal S5. The counter 126 includes a register and a down-counter. The counter 126 converts a digital signal representative of a desired duration of the opening of the fuel injection valves 6, that is, a desired fuel injection quantity during a fuel injection stroke determined by the CPU 121, into a pulse signal S9 having a pulse-width or pulse-duration corresponding to the desired duration of the opening of the fuel injection valves 6. The pulse signal S9 is transmitted from the counter 126 to the output circuit 127 via a connection between the units 126 and 127. The output circuit 127 includes an amplifier which derives the fuel injection pulse signal S2 from the pulse signal S9. The duration of a fuel injection pulse S2 corresponds to the desired duration of the opening of the fuel injection valves 6, that is, the desired fuel injection quantity. The output circuit 127 is connected to the fuel injection valves 6 to feed the fuel injection signal S2 thereto. The duration of each fuel injection pulse S2 corresponds to the desired fuel injection quantity so that the actual fuel injection quantity during each fuel injection stroke can be equal to the desired fuel injection quantity when all of the fuel injection valves 6 operate normally. The output port 128 feeds the alarm signals S7A and S7B to the alarm 13 via a connection between the units 128 and 13.

Other sensors for detecting additional operating conditions of the engine 1 which are used to determine a desired fuel injection rate and a desired spark timing are omitted from FIGS. 1 and 2. Spark plugs and an ignition system are also omitted from FIGS. 1 and 2.

In respect of air-to-fuel ratio feed-back control, fuel injection control, and spark timing control, the engine control system of FIGS. 1 and 2 is designed in a manner similar to conventional engine control systems.

This invention uses a principle derived through experiments which will be described hereinafter.

Figure 3:
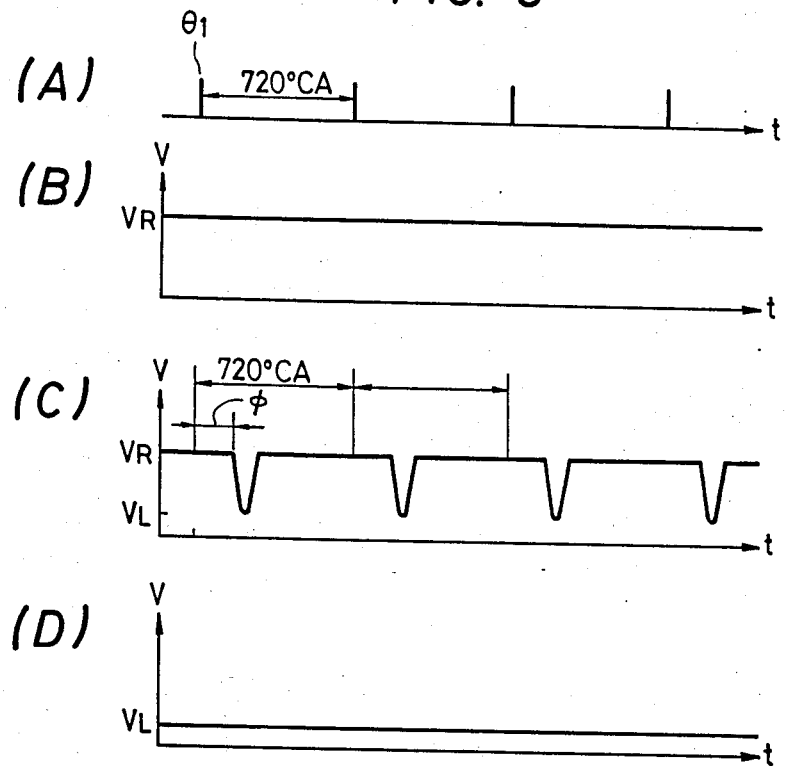
FIGS. 3A–3D show waveforms of the air-to-fuel ratio signal and the reference crank angle signal in the system of FIGS. 1 and 2 when fuel increase open-loop control is being performed.

In the engine control system of FIGS. 1 and 2, when the engine 1 is required to increase its power output or when the engine 1 is operated under high loads, the control circuit 12 disables air-to-fuel ratio feed-back control and enables air-to-fuel ratio open-loop control to supply the engine 1 with an air-fuel mixture richer than the stoichiometric mixture in a known way. This open-loop control is referred to as mixture enrichment open-loop control or fuel increase open-loop control. According to experiments under these engine operating conditions, when all of the fuel injection valves 6 operated normally, the air-to-fuel ratio signal S4 from the $O_2$ sensor 9 continuously remained at a high level state VR as shown by the waveform (B) in FIG. 3. It should be noted that the high level signal VR represents an air-fuel mixture richer than the stoichiometric mixture. Under the same engine operating conditions, when one of the fuel injection valves 6 malfunctioned, e.g., when one of the fuel injection valves 6 allowed a fuel injection rate less than a desired rate or did not allow any fuel injection, the air-to-fuel ratio signal S4 periodically moved between the high level state VR and a low level state VL as shown by the waveform (C) in FIG. 3. It should be noted that the low-level signal S4 represents an air-fuel mixture leaner than the stoichiometric mixture. Specifically, the air-to-fuel ratio signal S4 periodically assumed the low level state in synchronism with reference crank angle pulses S5, which are spaced at fixed crank angle intervals of 720° as shown by the waveform (A) in FIG. 3. In other words, the air-to-fuel ratio signal S4 periodically assumed the low level state VL is synchronism with two rotations of the engine crankshaft, that is, in synchronism with one engine operation cycle. In addition, the periodical low level signals VL, that is, the periodical mixture lean signals S4, had essentially a fixed phase $\phi$ with respect to the 720° reference crank angle pulses S5. Furthermore, the duration of each low level signal VL was much shorter than that of an adjacent high level signal VR. From the above-mentioned experimental results, it can be seen that the engine cylinder associated with the malfunctioned fuel injection valve 6 receives a lean air-fuel mixture or air only, which is unburned or partially burned and is then periodically emitted into the exhaust pipe arrangement 8, and that the air-to-fuel ratio signal S4 moves to the low level state VL when this unburned or partially burned gas reaches the $O_2$ sensor 9. Since emission of the unburned or partially burned gas into the exhaust system 8 is periodically performed in synchronism with engine operation cycle, the mixture lean signal VL occurs periodically in synchronism with engine operation cycle. When the $O_2$ sensor 9 broke down or short-circuited, the air-to-fuel ratio signal S4 constantly remained at the low level state VL as shown by the waveform (D) in FIG. 3. It should be noted that additional conditions of the experiments were as follows: One terminal of the $O_2$ sensor 9 was grounded and a fixed resistor of a low resistance was connected in parallel with the $O_2$ sensor 9, as disclosed in Japanese published unexamined utility model application No. 51-154616 or Japanese published unexamined patent application No. 52-100020.

Figure 4:
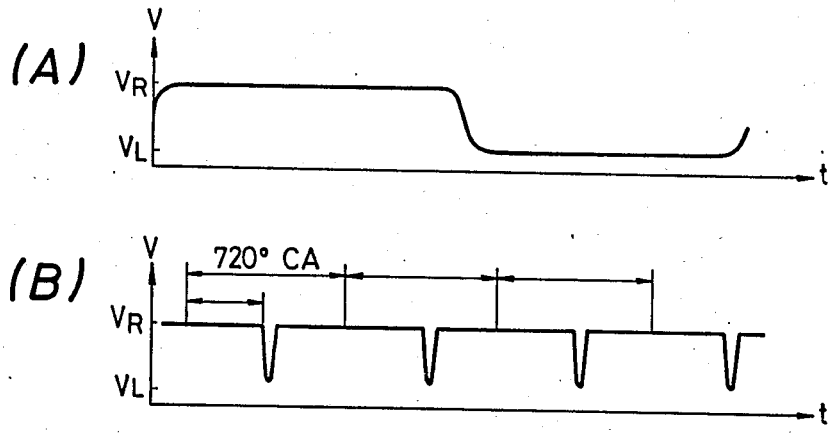
FIGS. 4A and 4B show waveforms of the air-to-fuel ratio signal when air-to-fuel ratio feed-back control is being performed.

According to experiments under conditions where the engine 1 warmed up and the air-to-fuel ratio feed-back control was enabled, when all of the fuel injection valves 6 normally operated, the air-to-fuel ratio signal S4 periodically moved between the high level state VR and the low level state VL as shown by the waveform (A) in FIG. 4. The frequency of this periodical movement depended on the engine speed and on a time lag in the air intake system and the exhaust system. In this case, the duration of a high level signal VR was comparable to that of an adjacent low level signal VL. Under the same engine operating conditions, when one of the fuel injection valves 6 malfunctioned, the air-to-fuel ratio signal S4 periodically moved between the high level state VR and the low level state VL as shown by the waveform (B) in FIG. 4. Specifically, the air-to-fuel ratio signal S4 periodically assumed the low level state VL in synchronism with the 720° reference crank angle pulses S5. In addition, the periodical mixture lean signals VL had a fixed phase with respect to the 720° crank angle pulses S5. Furthermore, the duration of each mixture lean signal VL is much shorter than that of an adjacent mixture rich signal VR. From the above-mentioned experimental results, it can be seen that the engine cylinder associated with the malfunctioned fuel injection valve 6 receives a lean air-fuel mixture or air only, while the other engine cylinders are supplied with rich air-fuel mixtures by the compensative effect of the air-to-fuel ratio feed-back control. It should be noted that the feed-back control serves to maintain the mixture air-to-fuel ratio at the stoichiometric value. The lean air-fuel mixture or air is unburned or partially burned, and is then emitted into the exhaust pipe arrangement 8. When this unburned or partially burned gas reaches the $O_2$ sensor 9, the air-to-fuel ratio signal S4 moves to the low level state VL. Since emission of the unburned or partially burned gas reiterates in synchronism with engine operation cycle, the mixture lean signal VL appears in synchronism with engine operation cycle.

In conclusion, a malfunction of the fuel injection valve or valves 6 can be detected by checking whether or not the mixture lean signal VL occurs periodically in synchronism with engine operation cycle, that is, in synchronism with the crankshaft revolution, when the engine 1 is subjected to the fuel increase open-loop control or when the engine 1 is subjected to the air-to-fuel ratio feed-back control.

The control circuit 12 operates in accordance with a periodically reiterated program stored in the ROM 123. The program includes a fuel control segment and a spark control segment. In compliance with the fuel control segment of the program, the control circuit 12 derives a desired fuel injection quantity during a fuel injection stroke from the various signals outputted by the engine condition sensors including the sensors 4, 7, 9, 10, and 11, and controls the fuel injection valves 6 in accordance with the desired fuel injection quantity via the fuel injection pulse signal S2. In compliance with thet spark control segment of the program, the control circuit 12 derives a desired spark timing from the engine condition signals, and controls the spark plugs in accordance with the desired spark timing via the spark control signal. In respect of these fuel control and spark control, the design and operation of the control circuit 12 are similar to those of a control circuit in conventional systems.

Figure 5:
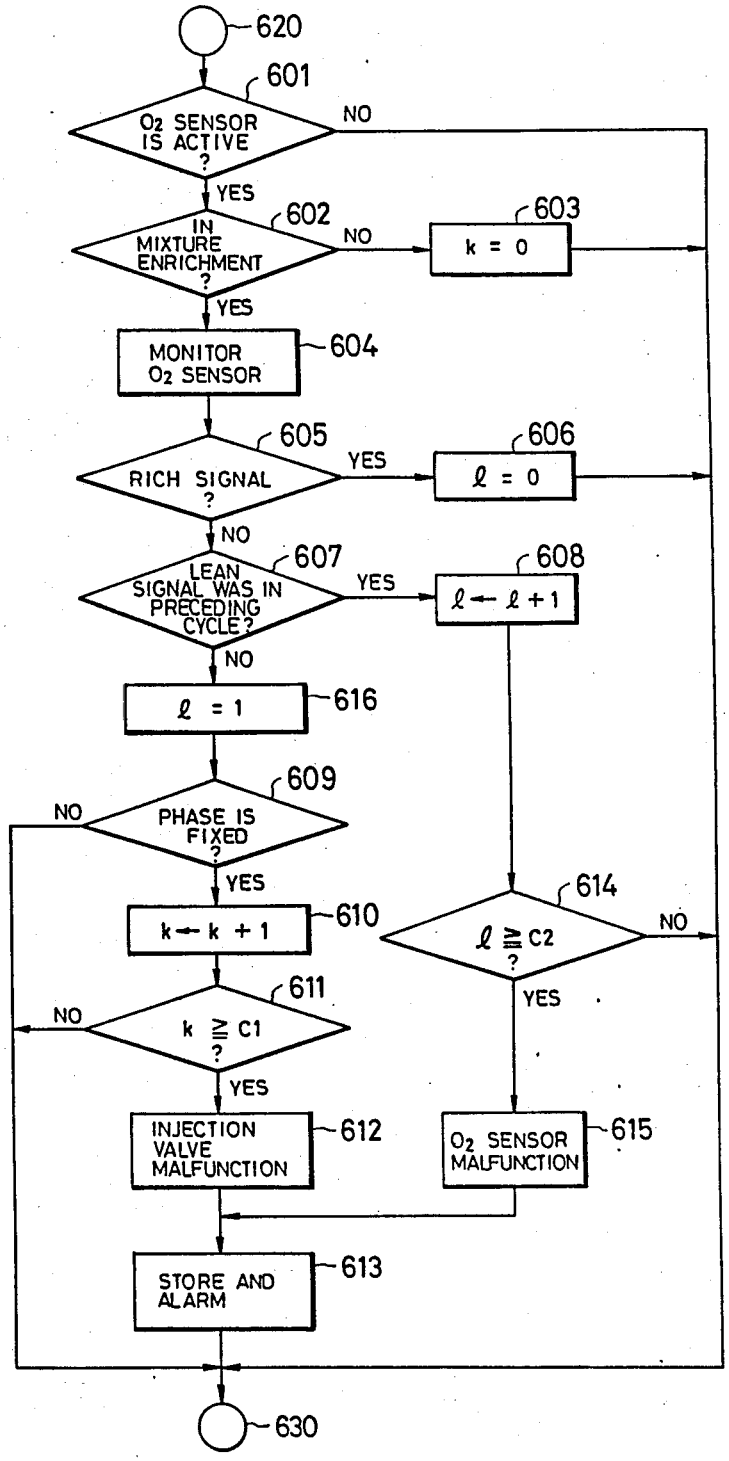
FIG. 5 is a flowchart of an alarm program operating the control circuit of FIGS. 1 and 2.

The program also includes an alarm segment. This alarm program is executed once per time interval of 2–4 milliseconds in compliance with interrupt timing control using a timer in the control circuit 12. FIG. 5 is a flowchart of this alarm program.

As shown in FIG. 5, when an interruption for the alarm program is required at a step 620, an initial step 601 of the alarm program determines whether or not the $O_2$ sensor 9 is active in accordance with the current coolant temperature derived from the signal S6. It should be noted that the $O_2$ sensor is active at above a certain temperature. The determination by the step 601 may be performed in other known ways. When the $O_2$ sensor 9 is active, the program advances to a step 602. When the $O_2$ sensor 9 is not active, the program jumps to an exit or return step 630 at which the alarm control process is returned to a state before the interruption.

The step 602 determines whether or not the mixture enrichment open-loop control is being performed. When this open-loop control is being performed, the program advances to a step 604. When this open-loop control is not being performed, the program jumps to the exit step 630 via a step 603 which sets a value represented by the variable k to zero or "0".

The step 604 monitors or samples the current voltage or level of the air-to-fuel ratio signal S4. After the step 604, the program advances to a step 605.

The step 605 discriminates whether or not the air-to-fuel ratio signal S4 monitored by the preceding step 604 is in the high level state, that is, the mixture rich state VR. When the signal S4 is in the mixture rich state VR, the program jumps to the exit step 630 via a step 606 which sets a value represented by the variable l to zero or "0". When the signal S4 is not in the mixture rich state VR, that is, when the signal S4 is in the low level or mixture lean state VL, the program advances to a step 607.

The step 607 determines whether or not the air-to-fuel ratio signal S4 was in the mixture lean state VL in the preceding execution cycle of the alarm program. When the signal S4 was in the mixture lean state VL, the program advances to a step 614 via a step 608 which increments the value l by one. When the signal S4 was not in the mixture lean state VL, the program advances to a step 609 via a step 616 which sets the value l to one or "1". Specifically, the determination by this step 607 is performed by discriminating whether or not the value l is zero. It should be noted that in the first execution of the alarm program after the change of the signal S4 from the mixture rich state VR to the mixture lean state VL, the value l is still zero when the program reaches the step 607. During this first execution cycle, the value l is changed to one by the step 616 following the step 607. Accordingly, in the second execution cycle of the alarm program after the change of the signal S4 from the mixture rich state VR to the mixture lean state VL, the value l is one when the program reaches the step 607.

As is suggested by the previous description, in the first execution cycle of the alarm program after the change of the air-to-fuel ratio signal S4 from the mixture rich state VR to the mixture lean state VL, the program moves from the step 605 to the step 609 by way of the steps 607 and 616. Accordingly, at essentially a moment of the initiation of the mixture lean signal VL, the program advances to the step 609. The step 609 detects the phase difference $\phi$ in unit of crank angle between the initiation of the mixture lean signal VL and a preset crank angle $\theta 1$ represented by the 720° reference crank angle pulse included in the signal S5. Specifically, when the 720° reference crank angle pulse occurs, a counter (not shown) in the control circuit 12 is set to start counting the unit reference crank angle pulses included in the signal S5. The step 609 detects the phase difference $\phi$ by reading the output of this counter. The step 609 may detect the phase difference $\phi$ in another way as follows. When the 720° reference crank angle pulse occurs, a counter (not shown) in the control circuit 12 is set to start counting clock pulses. The step 609 derives the time interval between moment of the occurence of the 720° signal and the moment of the change of the signal S4 from the mixture rich state VR to the mixture lean state VL by reading the output of this counter. Then, the step 609 calculates the phase difference $\phi$ from the detected time interval and the current engine speed derived from the crank angle signal S5 in the fuel control segment of the program. After the detection of the phase difference $\phi$, the step 609 determines whether or not the newly detected phase difference $\phi$ (new) is essentially equal to the precendently detected phase difference $\phi$ (old). When the current phase difference $\phi$ (new) is essentially equal to the preceding phase difference $\phi$ (old), the program advances to a step 611 via a step 610 which increments the value k by one. When the current phase difference $\phi$ (new) is not essentially equal to the preceding phase difference $\phi$ (old), the program jumps to the exit step 630.

The step 611 compares the value k with a reference number C1. When the value k is less than the reference number C1, the program jumps to the exit step 630. When the value k is equal to or larger than the reference number C1, the program advances to a step 612.

As a result of cooperation of the steps 609–611, in the case where the number of the occurrences of the mixture lean signal VL having fixed phases with respect to the 720° reference crank angle pulses S5 reaches a given value determined by the reference number C1, the program advances to the step 612. The step 612 sets an alarm variable to an ON state representing that at least one of the fuel injection valves 6 malfunctions. After the step 612, the program advances to a step 613 which stores the value or state of the alarm variable in a memory, preferably a non-volatile memory, within the control circuit 12 and then which energizes the first section of the alarm 13 via the alarm signal S7A to warn that at least one of the fuel injection valves 6 malfunctions. After the step 613, the program advances to the exit step 630.

The step 614 compares the value l with a reference number C2. When the value l is less than the reference number C2, the program jumps to the exit step 630. When the value l is equal to or larger than the reference number C2, the program advances to a step 615.

As a result of cooperation of the steps 607, 608, and 614, in the case where the mixture lean signal VL lasts for a time interval corresponding to a given number of the execution cycles of the alarm program determined by the reference number C2, the program moves to the step 615 which sets another alarm variable to an ON state representing that the $O_2$ sensor 9 malfunctions, e.g., breaks down or short-circuits. After the step 615, the program advances to the step 613 which stores the value or state of the $O_2$ sensor alarm variable in a memory, preferably a non-volatile memory, and which energizes the second section of the alarm 13 via the alarm signal S7B to warn that the $O_2$ sensor 9 malfunctions. After the step 613, the program advances to the exit step 630.

Figure 6:
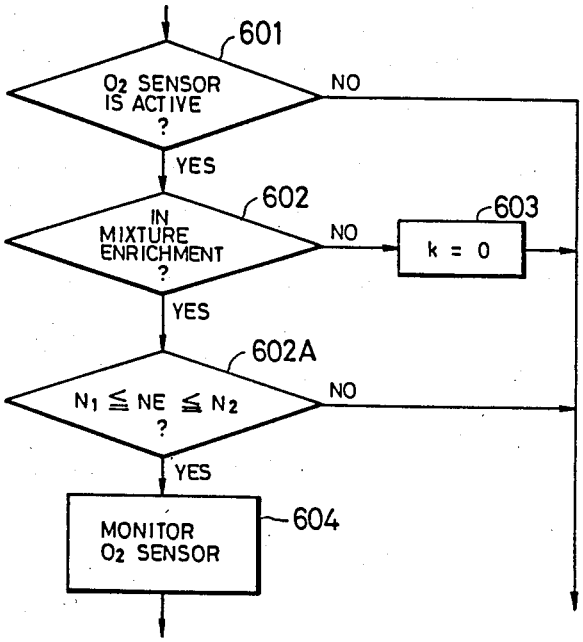
FIG. 6 is a flowchart of a modification to the alarm program of FIG. 5.
Figure 7:
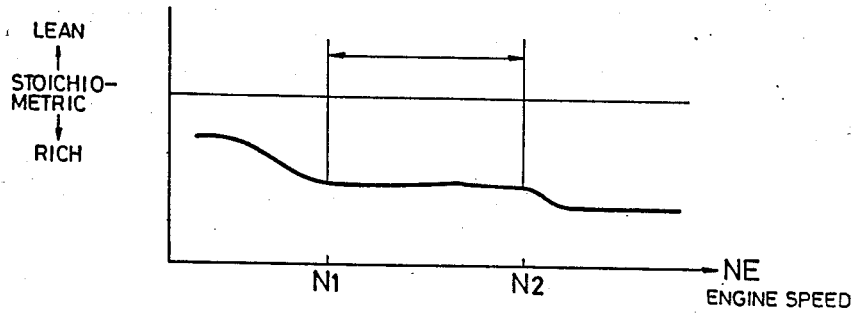
FIG. 7 is a graph showing the relationship between a desired air-to-fuel ratio and the engine speed in the system of FIGS. 1 and 2.

FIG. 6 shows a modification to the alarm program of FIG. 5. This modified alarm program is preferably applied to the engine control system in which the mixture enrichment open-loop control is designed to adjust the air-to-fuel ratio of an air-fuel mixture in accordance with the engine speed (NE) as shown in FIG. 7. Specifically, the degree of richness of the air-fuel mixture is small at low engine speeds, and is great at high engine speed. The degree of richness is moderate at intermediate engine speeds.

As shown in FIG. 6., in the modified alarm program, a step 602A is interposed between the steps 602 and 604. This step 602A determines whether or not the current engine speed NE resides in the intermediate engine speed range between reference values N1 and N2, e.g., 1,500 rpm and 3,000 rpm (see FIG. 7). When the engine speed NE resides in this range, the program advances to the step 604. When the engine speed NE is outside this range, the program jumps to the exit step 630 (see FIG. 5).

Accordingly, when the engine speed resides in the intermediate speed range, the subsequent essential steps to detect a malfunction are executed. When the engine speed is outside the intermediate speed range, that is, when the engine speed is high or low, the subsequent essential steps to detect a malfunction are not exected. This prevention of the execution of the essential steps increases the reliability of the detection of a malfunction for the following reasons. At low engine speeds, the degree of richness of the air-fuel mixture is small so that the mixture lean signal VL tends to occur occasionally. At high engine speeds, the degree of richness of the air-fuel mixture is great so that the mixture lean signal VL caused by a malfunction tends to become weak.

Figure 8:
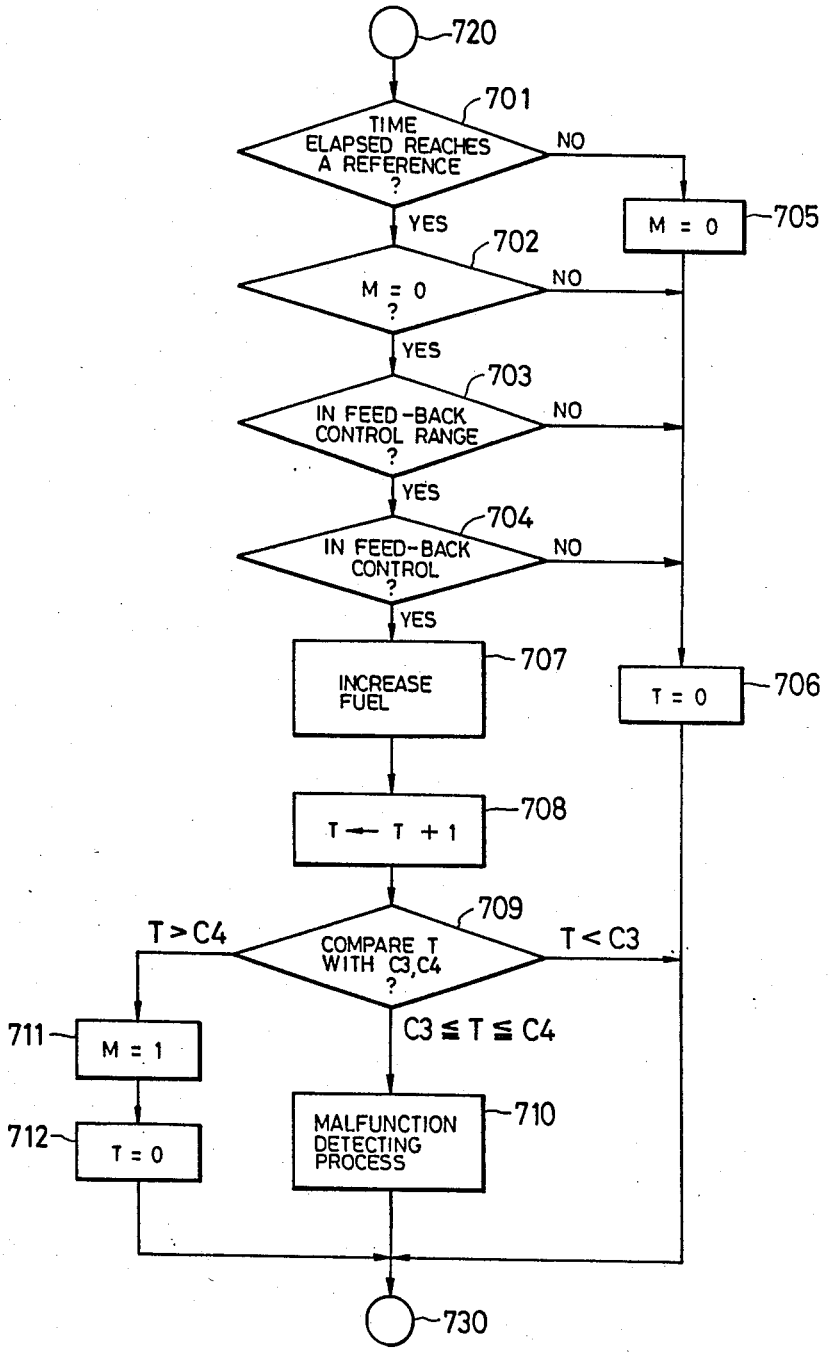
FIG. 8 is a flowchart of an alarm program according to a second embodiment of this invention.

A second embodiment of this invention is essentially similar to the embodiment of FIGS. 1–5 except for an alarm program. FIG. 8 is a flowchart of the alarm program in the second embodiment.

As shown in FIG. 8, when an interruption for the alarm program is requested at a step 720, an initial step 701 of the alarm program compares the time elapsed since the moment of the start of the engine 1 with a reference time interval required for completion of the warm-up of the engine 1. The reference time interval is preferably in the range of 20 to 30 minutes. If should be noted that the control circuit 12 includes a counter which detects this time elapsed by counting clock pulses since the engine start. When the time elapsed does not reach the reference time, the program advances to a step 705 which sets a value represented by the variable M to zero or "0". After the step 705, the program moves to an exit or return step 730 via a step 706 which sets a value represented by the variable T to zero or "0". It should be noted that the alarm control process is returned to a state before the interruption at the exit or return step 730. When the time elapsed reaches or exceeds the reference time, the program advances from the step 701 to a step 702.

The step 702 determines whether or not the value M is zero. When the value M is not zero, the program jumps to the exit step 730 via the step 706 which sets the value T to zero. When the value M is zero, the program advances to a step 703.

The step 703 detects, in a known way, whether or not the current engine operating conditions are suitable for the air-to-fuel ratio feed-back control. When the engine conditions are not suitable for the feed-back control, the program jumps to the exit step 730 via the step 706 which sets the value T to zero. When the engine conditions are suitable for the feed-back control, the program advances to a step 704. The step 703 may be omitted. In this case, the step 704 is directly connected to the step 702.

The step 704 determines whether or not the air-to-fuel ratio feed-back control is being performed. When the feed-back control is not being performed, the program jumps to the exit step 730 via the step 706 which sets the value T to zero. When the feed-back control is being performed, the program advances to a step 707.

The step 707 increases a desired fuel injection quantity or rate which was determined in the fuel control program. This increased desired fuel injection quantity is transferred back to the fuel control program so that the actual fuel injection rate reflects the increased desired fuel injection quantity. The increase in the desired fuel injection quantity is designed to induce an air-fuel mixture richer than the stoichiometric mixture. After the step 707, the program advances to a step 709 via a step 708 which increments the value T by one.

The step 709 compares the value T with reference numbers C3 and C4. The reference number C3 is smaller than the reference number C4. When the value T is less than the smaller reference number C3, the program jumps to the exit step 730. When the value T resides between the reference numbers C3 and C4, the program advances to a malfunction detecting block 710 and then proceeds to the exit step 730. When the value T exceeds the larger reference number C4, the program moves to the exit step 730 via steps 711 and 712. The step 711 sets the value M to one or "1". The step 712 clears or sets the value T to zero.

The internal design of the malfunction detecting block 710 is similar to the segment of the alarm program composed of the steps 604–616 of FIG. 5.

As a result of cooperation of the steps 702, 707, 709, and 711, the increase in the desired fuel injection quantity by the step 707 continues for a given length of time determined by the reference number C4. The step 709 forces the malfunction detecting process by the block 710 to remain disabled until the time elapsed since the moment of the initiation of the increase in the desired fuel injection quantity reaches a given time determined by the reference number C3. This disablement during the given time allows for a time lag in the air intake system and the exhaust system of the engine 1. The steps 709 and 710 enable the malfunction detecting process for a given time interval determined by the reference numbers C3 and C4. This given time interval is preferably in the range of 1 to 10 seconds.

Figure 9:
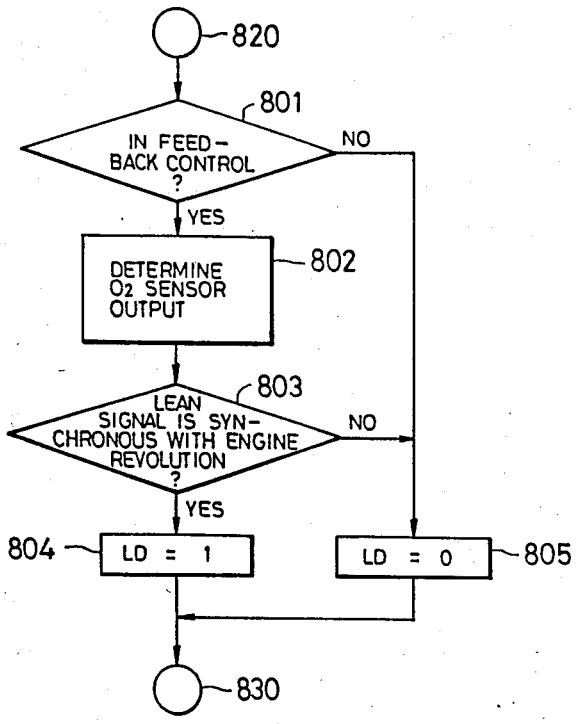
FIG. 9 is a flowchart of a first segment of an alarm program according to a third embodiment of this invention.
Figure 10:
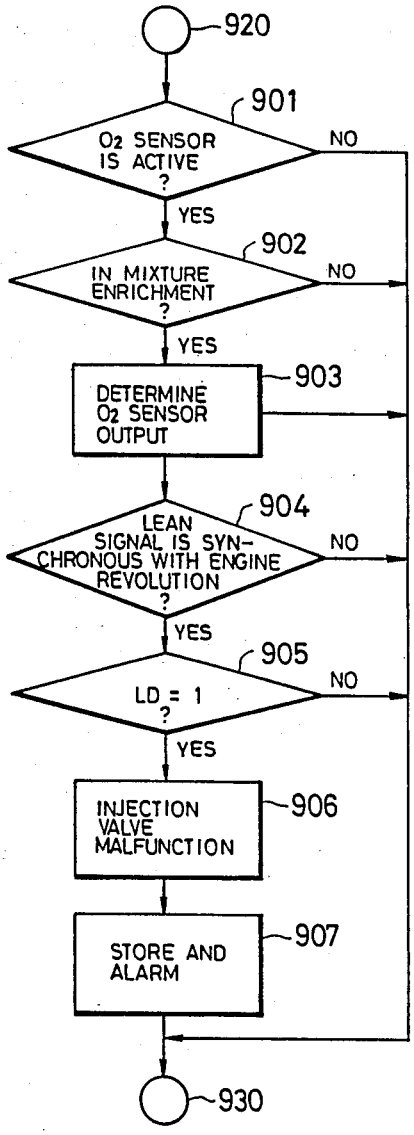
FIG. 10 is a flowchart of a second segment of the alarm program according to the third embodiment of this invention.

A third embodiment of this invention is essentially similar to the embodiment of FIGS. 1–5 except for an alarm program. The alarm program in the third embodiment includes first and second segments. FIGS. 9 and 10 are flowcharts of the first and second program segments respectively.

As shown in FIG. 9, when an interruption of the first segment of the alarm program is requested at a step 820, an initial step 801 of the first segment of the alarm program determines whether or not the air-to-fuel ratio feed-back control is being performed. When the feed-back control is not being performed, the program jumps to an exit or return step 830 via a step 805 which sets the flag or variable LD to zero or "0" and which stores the flag LD in the RAM 122. When the feed-back control is being performed, the program advances to a step 802.

The step 802 determines whether the air-to-fuel ratio signal S4 is in the mixture rich state VR or in the mixture lean state VL. When the signal S4 is in the mixture rich state VR, the program jumps to the exit step 830 via the step 805 which sets the flag LD to zero. When the signal S4 is in the mixture lean state VL, the step 802 detects the phase difference between the 720° reference crank angle and the initiation of the change of the signal S4 from the mixture rich state VR to the mixture lean state VL as in the program of FIG. 5. After the detection of the phase difference, the program advances to a step 803.

The step 803 determines whether or not the mixture lean signals VL have essentially fixed phases with respect to the 720° reference crank pulses, that is, whether or not the mixture lean signals S4 are synchronous with the engine crankshaft revolutions, by comparing the newly detected phase difference and the precedently detected phase difference as in the program of FIG. 5. When the mixture lean signals VL are out of synchronism with the engine crankshaft revolutions, the program advances to the exit step 830 via the step 805 which sets the flag LD to zero. When the mixture lean signals VR are synchronous with the engine crankshaft revolutions, that is, when at least one of the fuel injection valves 6 malfunctions, the program advances to the exit step 830 via a step 803 which sets the flag LD to one or "1" and which stores the flag LD in the RAM 122.

In this way, the flag LD equal to "1" represents that a malfunction of at least one of the fuel injection valves 6 is detected during the air-to-fuel ratio feedback control.

As shown in FIG. 10, when an interruption for the second segment of the alarm program is requested at a step 920, an initial step 901 of the second segment of the alarm program determines whether or not the $O_2$ sensor 9 is active in a way similar to the step 601 of FIG. 5. When the $O_2$ sensor 9 is not active, the program jumps to an exit or return step 930. When the $O_2$ sensor 9 is active the program advances to a step 902.

The step 902 determines whether or not the mixture enrichment open-loop control is being performed as in the step 602 of FIG. 5. When the mixture enrichment control is not being performed, the program jumps to the exit step 930. When the mixture enrichment control is being performed, the program advances to a step 903.

The step 903 is similar to the step 802 of FIG. 9. Accordingly, when the mixture lean signal VL is detected, the program advances to a next step 904.

The step 904 determines whether or not the mixture lean signals VL are synchronous with the engine crankshaft revolutions as in the step 803 of FIG. 9. When the mixture lean signals VL are out of synchronism with the engine crankshaft revolutions, the program jumps to the exit step 930. When the mixture lean signals VL are synchronous with the engine crankshaft revolutions, the program advances to a step 905.

The step 905 determines whether or not the flag LD is one. When the flag LD is not one, the program jumps to the exit step 930. When the flag LD is one, the program advances to a step 906. Accordingly, in the case where a malfunction was detected during the air-to-fuel ratio feed-back control, when a malfunction of at least one of the fuel injection valves 6 is detected during the mixture enrichment open-loop control, the program advances to the step 906.

The step 906 sets an alarm variable to an ON state representing that at least one of the fuel injection valves 6 malfunctions. After the step 906, the program advances to a step 907 which stores the value or state of the alarm variable in a memory, preferably a non-volatile memory, and which energizes the alarm 13 (see FIGS. 1 and 2) via the alarm signal S7A. After the step 907, the program advances to the exit step 930.

As is understood from the previous description, in the embodiment of FIGS. 9 and 10, the alarm 13 is energized to warn that at least one of the fuel injection valves 6 malfunctions in the case where malfunctions are detected during both the air-to-fuel ratio feed-back control and the mixture enrichment open-loop control.

It should be noted that further modifications may be made in this invention. For example, the alarm program segment of FIG. 10 can be omitted from the third embodiment. Furthermore, in the previously described embodiments, the engine cylinder associated with the malfunctioned fuel injection valve may be identified in accordance with the phase difference $\phi$ between the 720° reference crank angle pulse and the initiation of the mixture lean signal VL. In addition, a carbon monoxide (CO) sensor, a hydrocarbon (HC) sensor, or other air-to-fuel ratio sensors may be used in place of the $O_2$ sensor.

What is claimed is:

1. In an electronic engine control system which performs at least fuel injection control of an engine via fuel injection valves in response to control signals which are derived from output signals of sensors detecting operating conditions of the engine and from an output signal of an air-to-fuel ratio sensor disposed in an exhaust system of the engine in accordance with a program stored in a microcomputer, an alarm system comprising:

(a) first means for detecting when the fuel injection control is being operative to supply the engine with a rich air-fuel mixture;

(b) second means for detecting whether or not the air-to-fuel ratio sensor periodically generates mixture lean signals in synchronism with revolutions of an ouput shaft of the engine when the fuel injection control is being operative to supply the engine with the rich mixture; and (c) third means for determining a malfunction of at least one of the fuel injection valves in accordance with the detection by the second means.

2. The alarm system of claim 1 wherein the second means comprises fourth means for generating electrical pulses in synchronism with the revolutions of the engine output shaft, fifth means for detecting phase differences between the pulses and the mixture lean signals, and sixth means for determining whether or not the detected phase differences are essentially fixed.

3. The alarm system of claim 1 further comprising fourth means for detecting speed of the engine, and fifth means for detecting whether or not the detected engine speed is in a preset range, and sixth means for enabling the detecting by the second means when the detected engine speed is in the preset range.

4. The alarm system of claim 1 further comprising fourth means for detecting whether or not the air-to-fuel ratio sensor constantly outputs a mixture lean signal when the fuel injection control is being operative to supply the engine with the rich mixture, and fifth means for determining a malfunction of the air-to-fuel ratio sensor in accordance with the detection by the fourth means.

5. An alarm system for an engine including cylinders, fuel injection valves associated with the cylinders for supplying fuel to the cylinders respectively, the fuel injection valves being controlled in common, and means for supplying air to the cylinders, the alarm system comprising:

(a) means, disposed in an exhaust passage of the engine leading from the cylinders, for monitoring exhaust gas from the cylinders and detecting air-to-fuel ratio of air-fuel mixture in the cylinders;

(b) means for detecting periodical changes of the detected air-to-fuel ratio which are synchronous with operation cycles of the engine; and (c) means for, when the periodical changes of the detected air-to-fuel ratio is detected, alarming that at least one of the fuel injection valves malfunctions.

6. The alarm system of claim 5 wherein the periodical change detecting means is operative to detect periodical changes of the detected air-to-fuel ratio from a mixture rich state to a mixture lean state in synchronism with operation cycles of the engine when the fuel injection valves are controlled to supply the engine with an air-fuel mixture richer than a stoichiometric mixture in an open loop.

7. The alarm system of claim 5 wherein the periodical change detecting means is operative to detect periodical changes of the detected air-to-fuel ratio from a mixture rich state to a mixture lean state in synchronism with operation cycles of the engine when the fuel injection valves are controlled to supply the engine with a soichiometric air-fuel mixture in a closed loop.

8. The alarm system of claim 5 wherein the periodical change detecting means is operative to detect periodical changes of the detected air-to-fuel ratio from a mixture rich state to a mixture lean state in synchronism with operation cycles of the engine when the fuel injection valves are controlled to supply the engine with an air-fuel mixture richer than a stoichiometric mixture in an open loop and when the fuel injection valves are controlled to supply the engine with a stoichiometric air-fuel mixture in a closed loop, and wherein the malfunction of the fuel injection valves is alarmed in the case where the periodical changes of the detected air-to-fuel ratio is detected both when the fuel injection valves are controlled in the open loop and when the fuel injection valves are controlled in the closed loop.

9. The alarm system of claim 5 wherein the air-to-fuel ratio detecting means comprises an $O_2$ sensor.

10. An alarm system for an engine, comprising:

(a) means for generating a signal representing a desired air-to-fuel ratio of an air-fuel mixture in the engine;

(b) means for supplying air to the engine;

(c) means for supplying fuel to the engine in accordance with the signal and thus adjusting actual air-fuel ratio of a mixture of the air and the fuel in the engine to the desired air-to-fuel ratio when operating normally;

(d) means for detecting the actual ratio of the air-fuel mixture; and (e) means for detecting a mulfunction of the fuel supply means in accordance with a difference between the desired air-to-fuel ratio and the detected actual air-to-fuel ratio.

* * * * *